US012435496B2

(12) United States Patent
Huang et al.

(10) Patent No.: US 12,435,496 B2
(45) Date of Patent: Oct. 7, 2025

(54) WATER OUTLET STRUCTURE

(71) Applicant: Beijing Kohler Ltd., Beijing (CN)

(72) Inventors: Jiagao Huang, Beijing (CN); Zheyuan Zhang, Miyun District (CN)

(73) Assignee: Beijing Kohler Ltd., Beijing (CN)

( * ) Notice: Subject to any disclaimer, the term of this patent is extended or adjusted under 35 U.S.C. 154(b) by 62 days.

(21) Appl. No.: 18/319,605

(22) Filed: May 18, 2023

(65) Prior Publication Data

US 2024/0044116 A1 Feb. 8, 2024

(30) Foreign Application Priority Data

Aug. 5, 2022 (CN) ..... 202222075037.3

(51) Int. Cl.
*E03C 1/04* (2006.01)

(52) U.S. Cl.
CPC ..... *E03C 1/04* (2013.01); *Y10T 137/9464* (2015.04)

(58) Field of Classification Search
CPC ..... Y10T 137/9464
USPC ..... 137/801
See application file for complete search history.

(56) References Cited

U.S. PATENT DOCUMENTS 5,258,592 A * 11/1993 Nishikawa ..... H01H 13/063 200/302.2
5,655,650 A * 8/1997 Naitou ..... H01H 13/705 200/512
5,699,832 A * 12/1997 Burchard ..... E03C 1/04 251/149.6
5,859,127 A * 1/1999 Nakano ..... C08L 67/06 525/23
2006/0009982 A1* 1/2006 Janzen ..... A63H 5/00 704/272
2020/0248438 A1* 8/2020 Wang ..... E03C 1/0405
2021/0052001 A1* 2/2021 McCloy ..... A24F 13/00

* cited by examiner

*Primary Examiner* — Daphne M Barry
(74) *Attorney, Agent, or Firm* — Foley & Lardner LLP

(57) ABSTRACT

The present disclosure relates to an outlet structure having a body defining a fluid flow path and a control mechanism at least partially coupled to a through hole defined by the body. The control mechanism can control a flow of fluid in the fluid flow path. The control mechanism includes a button at least partially extending through the through hole of the body. A flexible cover is coupled to the through hole to seal the button with the body.

20 Claims, 4 Drawing Sheets

WATER OUTLET STRUCTURE

CROSS-REFERENCE TO RELATED PATENT APPLICATIONS

This application claims the benefit of and priority to Chinese Patent Application No. 202222075037.3, filed Aug. 5, 2022, which is incorporated herein by reference in its entirety.

TECHNICAL FIELD

The present disclosure relates to the field of sanitary products, and particularly to a fluid outlet assembly for various faucets, showerheads, or similar products.

BACKGROUND

In various sanitary products, such as showerheads and faucets, some water outlet structures may include a control mechanism that can control a flow of fluid in various ways. In some instances, for example, the control mechanism may be controlled by a button that extends through a hole defined by a portion of a body of the product. In such instances, any gaps formed between the button and the body may store dust and other debris, which is difficult to clean, easy to breed bacteria, and lowers a user's experience. Accordingly, it may be advantageous to provide a new water outlet structure for such products.

SUMMARY

At least one aspect of the present disclosure relates to a water outlet structure. The water outlet structure includes a body defining a fluid flow path and a control mechanism at least partially coupled to a through hole defined by the body. The control mechanism can control a flow of fluid in the fluid flow path. The control mechanism includes a button at least partially extending through the through hole of the body. A flexible cover is coupled to the through hole to seal the button with the body.

In some embodiments, the body includes a groove formed on an inner surface of the body around the through hole. The groove can receive a portion of the flexible cover.

In some embodiments, the flexible cover includes a cover body for accommodating the button and a cover border connected to an edge of the cover body, the cover border is mounted in the groove, and the cover body is assembled in the through hole.

In some embodiments, the cover border and the cover body are integrally formed.

In some embodiments, the cover border is fitted into the groove.

In some embodiments, the flexible cover is a transparent silicone cover.

In some embodiments, the flexible cover is a transparent rubber cover.

In some embodiments, the button includes a decorative part provided on an end face of the button.

In some embodiments, the decorative part includes at least one corrugation.

In some embodiments, the decorative part includes at least one pattern.

In some embodiments, when the button is in an initial state, at least part of the flexible cover extends through the through hole of the body.

In some embodiments, the control mechanism includes a mechanical valve to control the flow of fluid in the fluid flow path.

At least one aspect of the present disclosure relates to a faucet. The faucet includes a body defining a fluid flow path and a control mechanism at least partially coupled to a through hole defined by the body. The control mechanism can control a flow of fluid in the fluid flow path. The control mechanism includes a button at least partially extending through the through hole of the body. A flexible cover is coupled to the through hole to seal the button with the body.

In some embodiments, the body includes a groove formed on an inner surface of the body around the through hole and the groove can receive a portion of the flexible cover.

In some embodiments, the flexible cover includes a cover body for accommodating the button and a cover border connected to an edge of the cover body, the cover border is mounted in the groove, and the cover body is assembled in the through hole.

In some embodiments, the cover border and the cover body are integrally formed.

In some embodiments, the cover border is fitted into the groove.

In some embodiments, the flexible cover is a transparent silicone cover.

In some embodiments, the flexible cover is a transparent rubber cover.

In some embodiments, the button includes a decorative part provided on an end face of the button.

BRIEF DESCRIPTION OF THE DRAWINGS

With reference to the drawings, the contents disclosed by the present disclosure will be more easily understood. It should be understood that these drawings are merely used for illustration and are not intended to limit the protection scope of the present disclosure. In the drawings.

DETAILED DESCRIPTION

Figure 1:
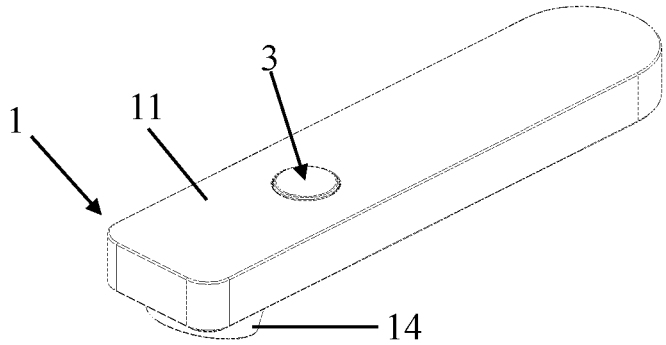
FIG. 1 is a perspective view of a water outlet structure provided by an embodiment of the present disclosure.

According to the present disclosure, a water outlet assembly is equipped with a control mechanism to control waterflow. The control mechanism may be triggered by a button. For example, the control mechanism may be a mechanical valve mounted in the water flow path, and a user may press an operating button to trigger the mechanical valve to close the water path. The control mechanism may also be a combination of a solenoid switch and a solenoid valve, the solenoid valve is mounted in the water path and the solenoid switch is mounted in the main body of the outlet structure, and the user presses the operating button to trigger a trigger end of the solenoid switch, which controls the solenoid valve to close the water path.

The present disclosure aims to provide a new water outlet structure of a sanitary product (e.g., faucet, shower, or another similar product) including a button that controls a flow of fluid within the product. The water outlet structure includes a flexible protective cover coupled to a through hole on a main body of the product to cover the button. The flexible protective cover hermetically seals the button with the body of product to prevent water, dust, or other debris from building up between the button and the body.

Referring generally to FIGS. 1-8, a water outlet structure provided by an embodiment of the present disclosure includes a water outlet body having a water or other fluid flow path and a control mechanism mounted in the water outlet body to control a flow of water through the water outlet body. The water outlet structure provided by the present disclosure can be used in sanitary products, which may include a faucet, a showerhead, and/or other products having fluid flow paths and outlets.

Referring to FIGS. 1-8, a water outlet structure includes a water outlet body 1. The water outlet body 1 includes an upper shell 11, a lower shell 12, and a water flow path 13 formed between the upper shell 11 and the lower shell 12. A front end of the water outlet body 1 has an outlet 14 and a rear end of the water outlet body 1 has an inlet 16. The outlet 14 and the inlet 16 may be coupled to (e.g., formed as part of) the lower shell 12. The water outlet body 1 includes a main body through hole 15 defined on a top surface or side surface of the upper shell 11.

The water outlet structure includes a control mechanism 2. In some embodiments, the control mechanism 2 includes a mechanical valve, which is mounted in the water path 13. In some embodiments, the control mechanism 2 includes a combination of a solenoid switch and a solenoid valve in which the solenoid valve is mounted in the water path 13 and the solenoid switch is in a cavity defined by the water outlet body 1. The control mechanism 2 may facilitate controlling a flow of water within the water path 13.

The control mechanism 2 includes a button 20. The button 20 can be a slider button or a push button. The button 20 can extend through and/or at least partially protrude out from the main body through hole 15. In embodiments in which the control mechanism 2 is a mechanical valve, a user may press the operating button 20 to trigger the mechanical valve, thereby closing the water path 13.

Figure 2:
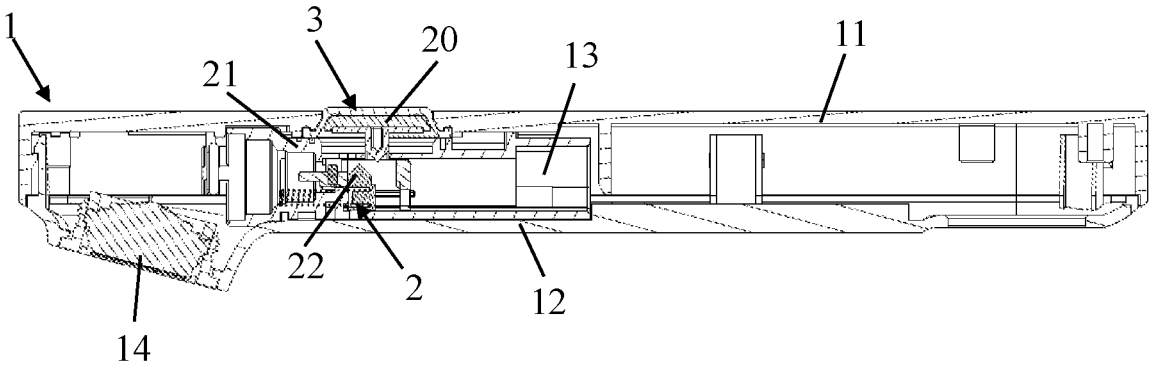
FIG. 2 is a sectional view of the water outlet structure shown in FIG. 1 along the length direction.
Figure 3:
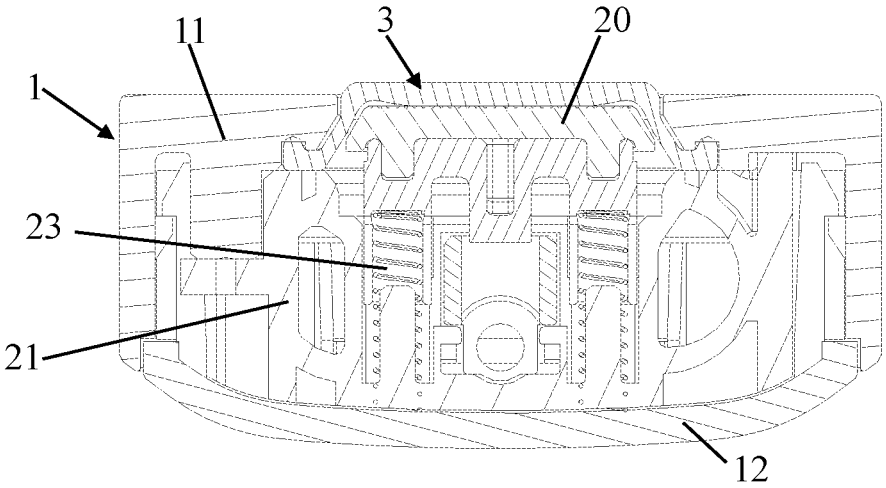
FIG. 3 is a sectional view of the water outlet structure shown in FIG. 1 along the width direction.
Figure 4:
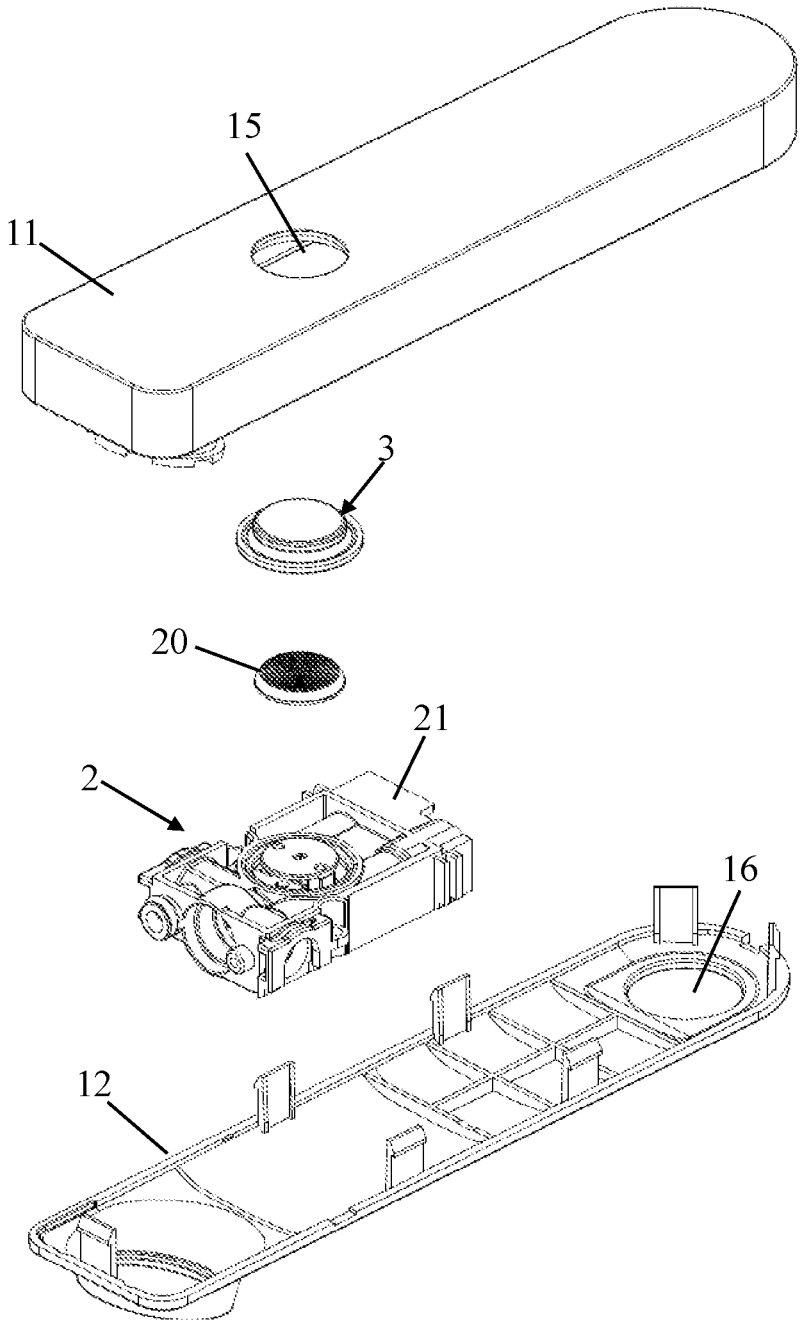
FIG. 4 is an exploded view of the water outlet structure shown in FIG. 1.
Figure 5:
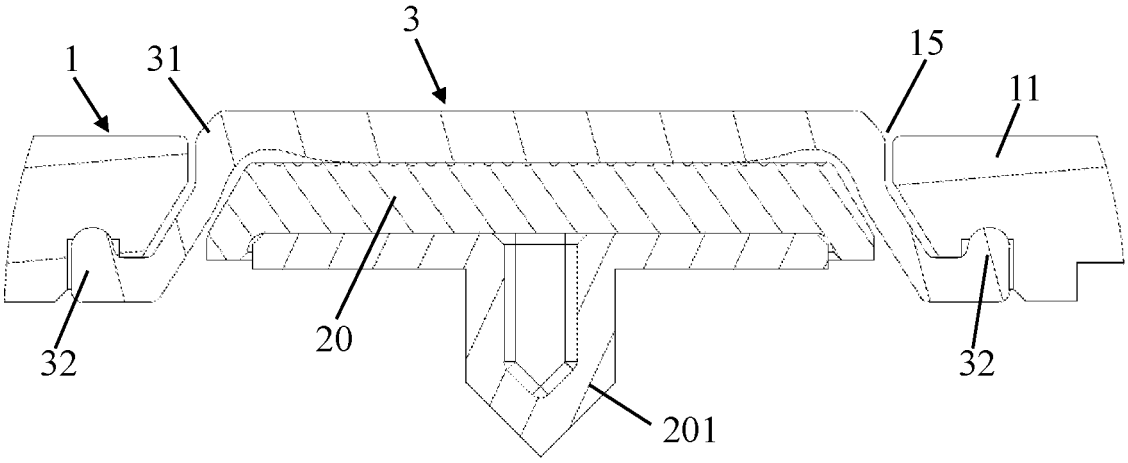
FIG. 5 is a sectional view of a flexible protective cover and a button assembled with a main body through hole of the water outlet structure shown in FIG. 1.
Figure 6:
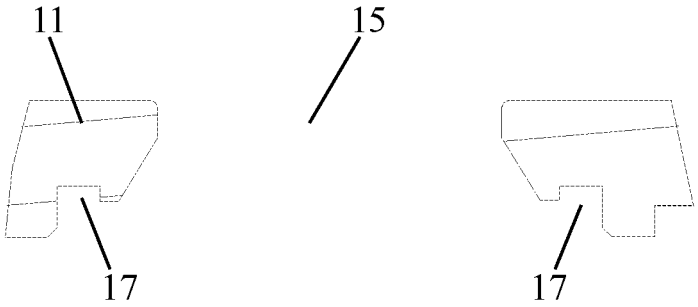
FIG. 6 is a schematic of the main body through hole with a groove formed around the main body through hole.
Figure 7:
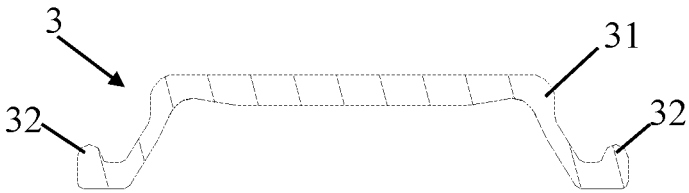
FIG. 7 is a sectional view of the flexible protective cover.
Figure 8:
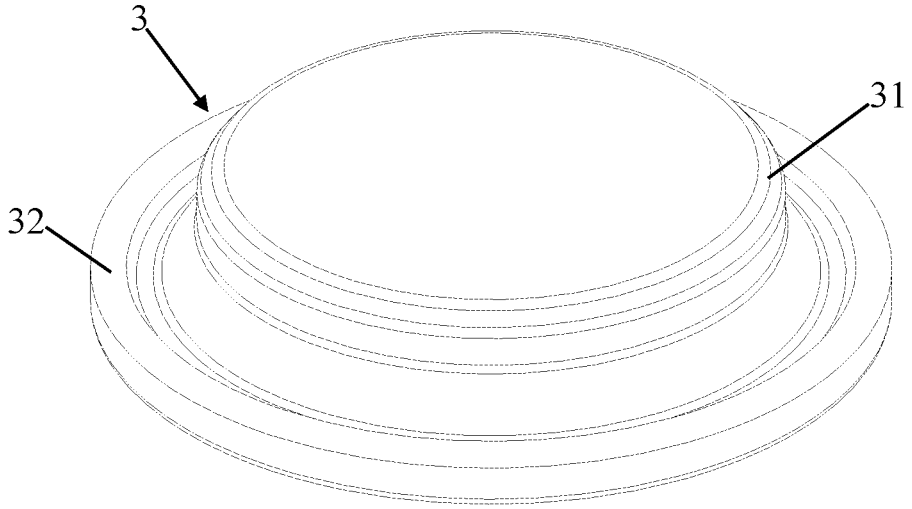
FIG. 8 is a perspective view of the flexible protective cover.

For example, the mechanical valve (e.g., the control mechanism 2) can include a mechanical valve body 21 and a plunger 22 (as depicted in at least FIG. 2). The button 20 is slidingly connected with the mechanical valve body 21. The button 20 is aligned with the main body through hole 15 and at least partially protrudes out from the main body through hole 15 so as to be pressed and operated by a user. As shown in FIG. 3, an elastic member 23 (e.g., a spring) is connected between the mechanical valve body 21 and the button 20 to drive the button 20 in an upward direction (e.g., towards the main body through hole 15). An end of the button 20 facing the plunger 22 has a button trigger end 201 (e.g., a protrusion), depicted in FIG. 5. When the user presses the button 20, the button trigger end 201 contacts the plunger 22, and the plunger 22 closes the water path 13. When the user releases the button 20, the button trigger end 201 moves away from the plunger 22, and the plunger 22 automatically resets to open the water path 13 under a spring action by the elastic member 23.

In embodiments in which the control mechanism 2 is a combination of a solenoid switch and a solenoid valve, a user may press the operating button 20 to actuate the solenoid switch, and the solenoid switch controls the solenoid valve to close the water path 13. For example, the solenoid valve (e.g., the control mechanism 2) is electrically connected with the solenoid switch signal and the button 20 is slidingly connected with the water outlet body 1 (e.g., such that the button can move up and down in a vertical direction). The solenoid switch is on the inner side of the button 20 (e.g., a side closes to the water path 13). The button trigger end 201 of the button can face and/or contact an end of the switch. An elastic member 23 (e.g., spring) is connected between the water outlet body 1 and the button 20 for driving the button 20 towards the main body through hole 15. When the user presses the button 20, the button trigger end 201 contacts the switch, the solenoid switch sends a first control signal to the solenoid valve, and the solenoid valve closes the water path 13. When the user releases the button 20, the button trigger end 201 moves away from the switch, the solenoid switch sends a second control signal to the solenoid valve, and the solenoid valve opens the water path 13.

The water outlet structure includes a flexible protective cover 3. The flexible protective cover 3 may be made of rubber, silicone, or other flexible materials. The flexible protective cover 3 is coupled to the main body through hole 15. The button 20 is positioned on an inside of the flexible protective cover 3 (e.g., a side facing the water path 13). The flexible protective cover 3 covers the button 20 and seals the main body through hole 15. When a user operates the button 20, a user can contact the flexible protective cover 3 (e.g., with a user's finger). In some embodiments, as shown in FIG. 1, when the button 20 is in the initial state, at least part of the flexible protective cover 3 extends to the outside of the main body through hole 15, and the user does not need to insert a finger into the main body through hole 15 to press the button 20 in the initial state. Therefore, the button 20 is easily operable.

With the flexible protective cover 3 sealing the main body through hole 15, the flexible protective cover 3 prevents dust, water, or other debris from building up between the button 20 and the upper shell 11, which is beneficial for keeping the water outlet structure clean thereby enhancing the user experience. In some embodiments, the flexible protective cover 3 may be at least partially or entirely transparent such that a user may observe the state of the button 20 from the outside. Additionally or alternatively, at least a portion of the flexible protective cover 3 may be adjusted to have different color or pattern to provide various aesthetics.

In some embodiments, as shown in FIGS. 5-8, a groove 17 may be formed on an inner surface of the water outlet body 1 around the main body through hole 15 to engage with the flexible protective cover 3. For example, the flexible protective cover 3 includes a protective cover body 31 for accommodating the button 20 and a protective cover border 32 (e.g., rim, flange, lip, etc.) connected to and extending from the edge of the protective cover body 31. The protective cover border 32 is connected to the edge of the protective cover body 31 and extends toward the groove 17. The protective cover border 32 can fit within the groove 17 and the protective cover body can fit within the main body through hole 15. In these embodiments, the groove 17 is formed on the inner surface of the upper shell 11 and surrounds the main body through hole 15 circumferentially.

The protective cover body 31 has a concave cavity to accommodate an end of the button 20. When assembled, the protective cover body 31 is fitted in the main body through hole 15 with clearance, the protective cover border 32 is fixedly connected in the groove 17, and the end of the button 20 is in the concave cavity of the protective cover body 31. The protective cover body 31 is fitted in the main body through hole 15 with clearance, and the protective cover body may be stretched, moved, etc. in the main body through hole 15, thus adapting to the needs for the user to operate the button 20.

The protective cover border 32 is fixedly connected in the groove 17, which is convenient for the assembly connection between the flexible protective cover 3 and the water outlet body 1, and also facilitates sealing the water outlet body 1. In some embodiments, the protective cover border 32 and the protective cover body 31 may be monolithic to facilitate processing and forming of the flexible protective cover 3.

In some embodiments, the width of the protective cover border 32 is greater than the width of the groove 17 and the protective cover border 32 is directly fitted in the groove 17 to keep the flexible protective cover 3 fixed in the groove 17 by the elastic force of the protective cover border 32.

Figure 9:
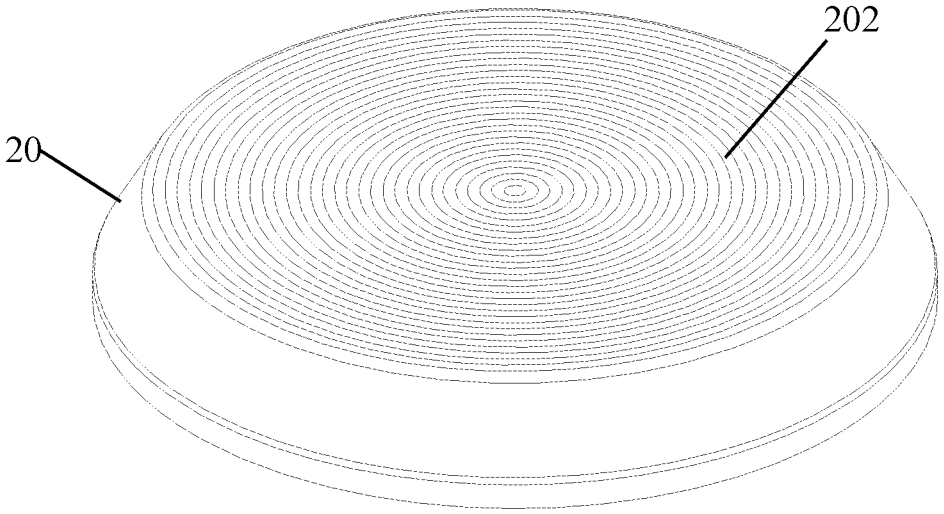
FIG. 9 is a perspective view of the button with a decorative part provided on it.

In some embodiments, as shown in FIG. 9, the end face of the button 20 is provided with a decorative part 202. The decorative part 202 may be provided with a pattern, coated with different colors, etc., and the user may observe the decorative part 202 from the outside of the transparent rubber cover, which provides an aesthetic effect. In some embodiments, as shown in FIG. 9, the decorative part 202 includes at least one decorative corrugation.

The above technical solutions may be combined as required to achieve the best technical effect.

The above are merely the principle and the preferred embodiments of the present disclosure. It should be pointed out that, for those of ordinary skills in the art, several other modifications may be made on the basis of the principle of the present disclosure, which should also be regarded as falling in the protection scope of the present disclosure.

It should be noted that the terms "front", "back", "left", "right", "up" and "down" used in the following description refer to the directions in the drawings, and the terms "inner" and "outer" refer to the directions towards or far away from geometric centers of specific parts respectively.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the present disclosure as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the showerheads as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Other substitutions, modifications, changes and omissions may also be made in the design, operating conditions and arrangement of the various exemplary embodiments without departing from the scope of the present disclosure. For example, any element (e.g., solenoid switch, valve, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A water outlet structure, comprising:

a body defining a fluid flow path; and a control mechanism at least partially coupled to a through hole defined by the body, the control mechanism configured to control a flow of fluid in the fluid flow path;

wherein the control mechanism includes:

a button at least partially extending through the through hole of the body; and a flexible cover coupled to the through hole to seal the button with the body;

wherein the flexible cover includes a cover body for accommodating the button and a cover border coupled to an edge of the cover body;

wherein an end of the button comprises a protrusion that extends into the body beyond the cover border of the flexible cover, the protrusion configured to engage with a component to open or close the fluid flow path;

wherein the body includes a groove formed on an inner surface of the body around the through hole;

wherein the groove is configured to receive the cover border of the flexible cover; and wherein a width of the cover border is greater than a width of the groove.

2. The water outlet structure according to claim 1, wherein:

the cover body is assembled in the through hole.

3. The water outlet structure according to claim 1, wherein the cover border and the cover body are integrally formed.

4. The water outlet structure according to claim 1, wherein the cover border is fitted into the groove.

5. The water outlet structure according to claim 1, wherein the flexible cover comprises a transparent silicone cover.

6. The water outlet structure according to claim 1, wherein the flexible cover comprises a transparent rubber cover.

7. The water outlet structure according to claim 1, wherein the button includes a decorative part provided on an end face of the button.

8. The water outlet structure according to claim 7, wherein the decorative part includes at least one corrugation.

9. The water outlet structure according to claim 7, wherein the decorative part includes at least one pattern.

10. The water outlet structure according to claim 1, wherein, when the button is in an initial state, at least part of the flexible cover extends through the through hole of the body.

11. The water outlet structure according to claim 1, wherein the component configured to open or close the fluid flow path comprises a mechanical valve to control the flow of fluid in the fluid flow path.

12. The water outlet structure according to claim 1, wherein the cover border defines a flange that extends in a direction that opposes the protrusion.

13. A faucet, comprising:

a body defining a fluid flow path; and a control mechanism at least partially coupled to a through hole defined by the body, the control mechanism configured to control a flow of fluid in the fluid flow path;

wherein the control mechanism includes:

a button at least partially extending through the through hole of the body; and a flexible cover coupled to the through hole to seal the button with the body;

wherein the flexible cover includes a cover body for accommodating the button and a cover border coupled to an edge of the cover body;

wherein an end of the button comprises a protrusion that extends into the body beyond the cover border of the flexible cover, the protrusion configured to engage with a component to open or close the fluid flow path;

wherein the body includes a groove formed on an inner surface of the body around the through hole;

wherein the groove is configured to receive the cover border of the flexible cover; and wherein a width of the cover border is greater than a width of the groove.

14. The faucet according to claim 13, wherein:

the cover body is assembled in the through hole.

15. The faucet according to claim 13, wherein the cover border and the cover body are integrally formed.

16. The faucet according to claim 13, wherein the cover border is fitted into the groove.

17. The faucet according to claim 13, wherein the flexible cover comprises a transparent silicone cover.

18. The faucet according to claim 13, wherein the flexible cover comprises a transparent rubber cover.

19. The faucet according to claim 13, wherein the button includes a decorative part provided on an end face of the button.

20. The faucet according to claim 13, wherein the cover border defines a flange that extends in a direction that opposes the protrusion.

* * * * *